United States Patent [19]

Rettemeier et al.

[11] Patent Number: 4,739,729

[45] Date of Patent: Apr. 26, 1988

[54] COAL-FIRED STEAM GENERATOR

[75] Inventors: Wulf Rettemeier, Gummersbach; Horst Müller, Bergneustadt; Bernd Sudau, Gummersbach, all of Fed. Rep. of Germany

[73] Assignee: L. & C. Steinmüller GmbH, Gummersbach, Fed. Rep. of Germany

[21] Appl. No.: 927,651

[22] Filed: Nov. 5, 1986

[30] Foreign Application Priority Data

Nov. 7, 1985 [DE] Fed. Rep. of Germany ..... 3539481

[51] Int. Cl.[4] ..... F22G 7/14

[52] U.S. Cl. ..... 122/476; 122/480

[58] Field of Search ..... 122/32–34, 122/7 R, 420–421, 460, 468, 476, 477, 479 R, 479 D, 480, 483, 485, 474

[56] References Cited

U.S. PATENT DOCUMENTS

| | | | |
|---|---|---|---|
| 2,926,636 | 3/1960 | Paulison, Jr. | 122/479 D |
| 2,985,153 | 5/1961 | Dickey | 122/479 D |
| 3,105,469 | 10/1963 | Fikenscher | 122/480 |
| 3,345,795 | 10/1967 | Stevens et al. | 122/480 |
| 3,396,705 | 8/1968 | Eickenberg | 122/480 |
| 4,515,109 | 5/1985 | Jullien | 122/32 |

FOREIGN PATENT DOCUMENTS 3203082 8/1983 Fed. Rep. of Germany .

OTHER PUBLICATIONS

VGB Kreftwerkstechnik, Von K. Knizia, Jun. 1985, pp. 545–557.

*Primary Examiner*—Steven E. Warner

*Attorney, Agent, or Firm*—Becker & Becker, Inc.

[57] ABSTRACT

A coal-fired steam generator that has a water-steam circulation and a low pressure-heat carrier-circulation which, via a heater that is disposed in the flue gas flow of the steam generator and that has at least one heat transfer surface, absorbs heat from the flue gas flow and conveys this heat to a process that utilizes heat, especially a gas turbine process in conjunction with a coal-combination unit having a steam turbine connected in the water-steam circulation. To optimize the position of the heater for the low pressure-heat carrier-circulation, especially a sodium circulation, there are provided at least two flue gas passes that are connected in parallel with a combustion chamber of the steam generator, whereby the flue gas flow coming from the combustion chamber is distributed to these flue gas passes, at least one of which is associated with a water-steam circulation, while the other is associated with the low pressure-heat carrier-circulation.

7 Claims, 1 Drawing Sheet

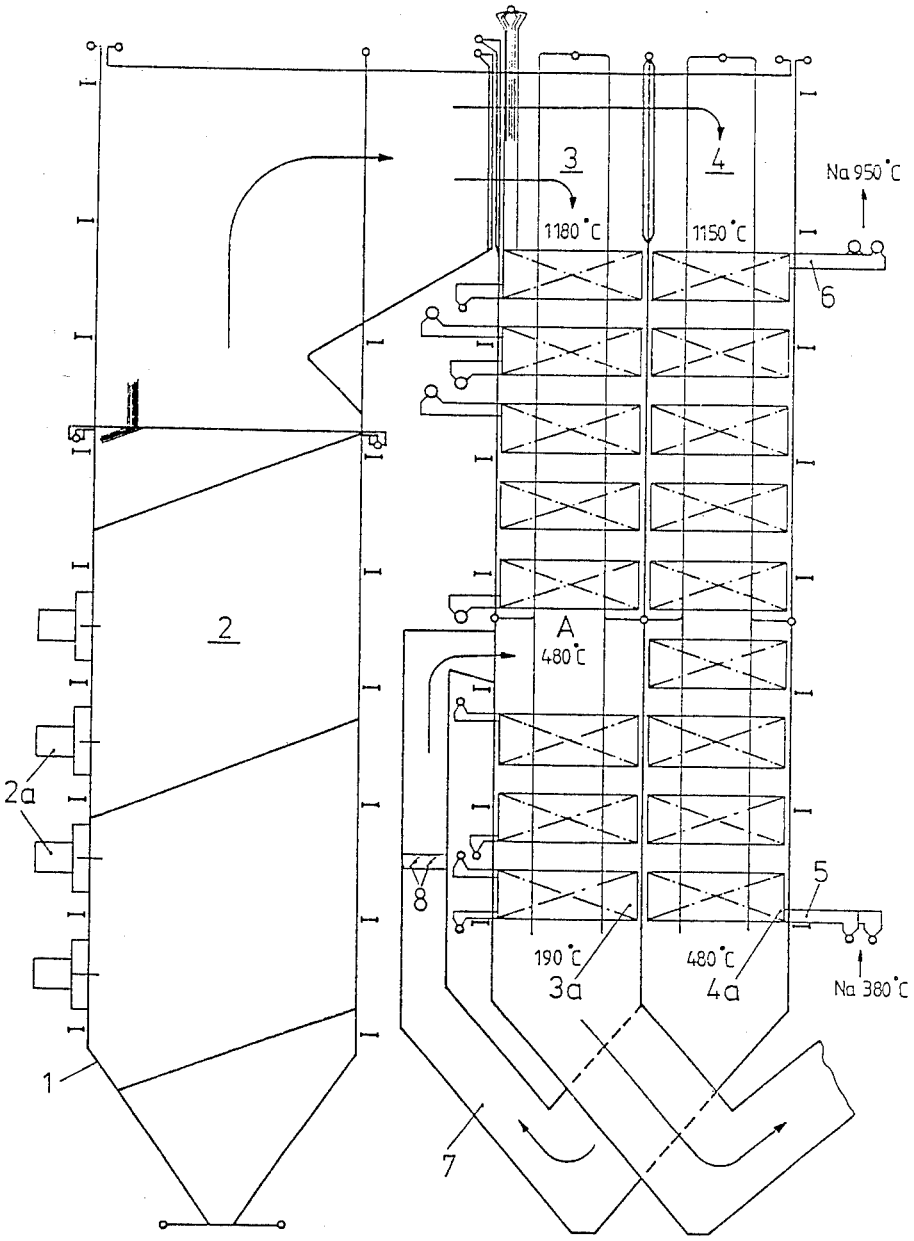
3
4
Na 950 °C
1180 °C
1150 °C
6
2
A
480 °C
2a
8
5
190 °C
480 °C
3a
4a
Na 380 °C
1
7

COAL-FIRED STEAM GENERATOR

BACKGROUND OF THE INVENTION

1. Field of the Invention

The present invention relates to a coal-fired steam generator that has a water-steam circulation in a low pressure-heat carrier-circulation which, via a heater that is disposed in the flue gas flow of the steam generator and that has at least one heat transfer surface, absorbs heat from the flue gas flow and conveys this heat to a process that utilizes heat, especially in conjunction with a coal-combination combined cycle unit having a steam turbine connected in the water-steam circulation and a gas turbine process.

In the present application, "low pressure-heat carrier" refers to a heat carrier that, in contrast to steam, can be utilized at lower pressures to convey heat. Included are helium, metals such as sodium, as well as oils and salts that at low pressures remain liquid until very high temperatures are reached, so that they can be conveyed via pumps.

2. Description of the Prior Art

VGB Kraftwerkstechnik, 65$^{th}$ year, issue 6 (1985), pages 545–557, especially FIGS. 10 and 11 on page 550, discloses a steam generator where the low pressure-heat carrier-circulation is a sodium circulation. Since the heat or the sodium circulation is released in the firing of the steam generator, which follows the gas turbine in the combined cycle, there exists the possibility for accommodating the sodium-steam heater in the steam generator in such a way that it is disposed at a location that for it is advantageous, whereas those heat transfer surfaces of the steam generator that are greatly stressed due to the combustion are water cooled as previously. This reduces the stress on the high-alloy materials required for the construction of the sodium heater.

An object of the present invention is to provide a particularly advantageous location for the arrangement of the low pressure heat exchanger.

BRIEF DESCRIPTION OF THE DRAWING

This object, and other objects and advantages of the present invention, will appear more clearly from the following specification in conjunction with the schematic drawing, which illustrates one exemplary embodiment of the inventive steam generator.

SUMMARY OF THE INVENTION

Pursuant to the present invention, at least two flue gas flows are connected in parallel with the combustion chamber of the steam generator, whereby the flue gas flow coming from the combustion chamber is distributed to these at least two flue gas flues, with at least one of the flue gas flues being associated with the water-steam circulation, and with at least one other flue gas flue being associated with the low pressure-heat carrier-circulation.

In the following, sodium will be addressed as the low pressure-heat carrier. It would also be possible to use other metals, such as potassium, or even alloys, such as sodium-potassium alloys (see FIG. 7 of the aforementioned citation), or gases such as helium, as well as oils and salts.

With separate flue gas flues, the inventive configuration of the steam generator offers the following advantages:

The sodium heater is not disposed directly over the burners, so that if there is a sodium leak, no sodium can enter the combustion chamber. Furthermore, during shutdown, no radiant heat absorption occurs into the heat transfer surfaces of the heater.

In addition, the separability of the sodium flue is assured, so that a more reliable subsequent operation of the steam generator can occur without heat absorption via the sodium circulation. Furthermore, the heat transfer surfaces disposed in the water-steam pass are to a large extent separated from the sodium heat transfer surfaces. With the sodium pass being disposed vertically, the on the whole resulting upward flow of the sodium in the heater permits a natural circulation, and hence an emergency cooling, upon failure of the pumping action in the sodium circulation.

The flue gas passes are preferably disposed next to one another, either in a horizontal or vertical arrangement. Due to the vertical orientation of the combustion chamber, a vertical arrangement of the flue gas passes is particularly expedient.

The partial flue gas flow that leaves the low pressure-heat carrier-flue gas pass is preferably conveyed into the water-steam pass at a level at which the temperature of the partial flue gas flow conveyed thereto essentially corresponds to the temperature of the flue gas that is flowing through the water-steam flue gas pass at that location. Conveying the flue gas from the one flue gas pass into the other flue gas pass is particularly advantageous since the flue gas in the sodium pass cannot be cooled dcwn to the same extent as the flue gas in the water-steam pas (for example, a 1150° C. inlet temperature of the flue gas into the sodium pass, and an outlet temperature of 480° C. out of the sodium flue, with a sodium inlet temperature of 380° C. and a sodium outlet temperature of 950° C.; and a 1180° C. inlet temperature of the flue gas into the water-steam flue gas pass, and an outlet temperature of 190° C. out of this pass).

The configuration of the heater as described in the previous paragraph makes it possible to adapt the thermal stress of the individual heat transfer surfaces to, for example, the materials used for these surfaces.

The sodium flue gas pass is preferably embodimed as a control pass, so that the absorption of heat via the sodium circulation can be regulated.

It is also expedient to have the combustion chamber of the steam generator and the two flue gas passes be disposed one after the other in such a way that the water-steam flue gas pass is disposed between the combustion chamber and the low pressure-heat carrier-flue gas pass. In this way, the sodium flue gas pass is accessible from at least three sides, so that in a case of sodium leakage, it is easier to correct the damage.

Due to the free space that is customarily present between the rising combustion chamber and the descending flue gas pass, it is expedient in this case to provide, at that location where the temperatures are approximately equal, a line for conveying the flue gas upwardly from the low pressure-heat carrier pass into the water-steam pass, with this line being disposed at least partially in the aforementioned free space.

Further specific features of the present invention will be described in detail subsequently.

DESCRIPTION OF PREFERRED EMBODIMENTS

Referring now to the drawing in detail, the inventive steam generator 1 comprises a combustion chamber 2 and two flue gas passes 3 and 4 that are connected in parallel. A plurality of coal-fired burners 2*a* are associated with the combustion chamber 2.

The flue gas pass 3, which is disposed between the combustion chamber 2 and the outwardly disposed flue gas pass 4, is associated with the water-steam-circulation of the steam generator and is provided with a plurality of heat transfer surfaces 3*a* that are contacted by water and/or steam. The flue gas pass 3 is essentially uniformly provided with heat transfer surfaces 3*a* up to the level A. The outwardly disposed flue gas pass 4 is tied in with a sodium circulation, for example with the sodium circulation of FIG. 10 or FIG. 11 of the aforementioned citation. Part of the sodium circulation is a heater which in the illustrated embodiment comprises a plurality of heat transfer surfaces 4*a* that are disposed one above the other, and are connected in series. A relatively cold sodium enters the heater from below via one or more inlet lines 5. After being heated up, the sodium is withdrawn via one or more outlet lines 6. While the sodium rises from the bottom to the top in the heat transfer surfaces 4*a* that are connected in series, the partial flue gas stream associated with the flue gas pass 4 flows in a countercurrent manner from the top to the bottom. The flue gas exiting at the bottom from the flue gas pass 4 is conveyed via a flue gas channel 7 to the flue gas pass 3 at the level A, since the outlet temperature of the flue gas as it exits the flue gas pass 4 essentially corresponds to the temperature that exists at the level A. One or more control valves 8 are disposed in the flue gas channel or channels 7 in order to regulate the quantity of flue gas entering the flue gas pass 3, and hence to regulate the heat that is to be absorbed by the sodium circulation. A connecting line that can be connected or disconnected can preferably be disposed between the inlet 5 and the outlet 6. When the circulating pump or pumps that are present in the sodium circulation fail, this connection line can be connected in order to provide a natural circulation or emergency cooling. It is also possible to associate appropriate bypass lines with the pumps.

The heat transfer surfaces 3*a* and 4*a* are preferably disposed in the same planes so that the same platforms, and possibly the same auxiliary devices, can be associated therewith.

It should be noted that the term "coal" as used in this application refers to bituminous coal, lignite, coke, and in the broadest sense, other solid fuels or secondary fuels derived therefrom (see, for example, FIG. 10 of the aforementioned citation).

Finally, it should be noted that the heater preferably comprises a plurality of heat transfer surfaces 4*a* that are related to the low pressure-heat carrier-circulation, are connected in series, and are disposed in parallel flow of countercurrent relative to the flue gas flow.

The present invention is, of course, in no way restricted to the specific disclosure of the specification and drawing, but also encompasses any modifications within the scope of the appended claims.

What we claim is:

1. In a coal-fired steam generator that has a water-steam circulation, and also has a low pressure-heat carrier-circulation which, via a heater that is disposed in the flue gas flow coming from the combustion chabmer of the steam generator and that has at least one heat transfer surface, absorbs heat from said flue gas flow and conveys this heat to a process that utilizes heat, the improvement comprising:

at least two flue gas passes connected in parallel with said combustion chamber of said steam generator, whereby said flue gas flow coming from said combustion chamber is distributed in partial flows to said at least two flue gas passes, with at least one of said flue gas passes being associated with said water-steam circulation, and with at least one other flue gas passes being associated with said low pressure-heat carrier-circulation; and means for receiving a partial flue gas flow from said flue gas pass that is associated with said low pressure-heat carrier-circulation, with said means conveying said partial flue gas flow into said flue gas pass that is associated with said water-steam circulation at that level of said last-mentioned pass where the temperature of said partial flue gas flow essentially corresponds to the temperature, at that level, of flue gas already flowing in said last-mentioned flue.

2. A steam generator according to claim 1, in which said flue gas passes are disposed next to one another.

3. A steam generator according to claim 2, in which said flue gas passes are oriented vertically.

4. A steam generator according to claim 1 in which said heater is composed of a plurality of heat transfer surfaces which, relative to said low pressure-heat carrier-circulation, are connected in series, and which are disposed in parallel flow or countercurrent relative to said partial flue gas flow.

5. A steam generator according to claim 4, in which said heat carrier is sodium, and said flue gas pass associated with its circulation is embodied as a control flue.

6. A steam generator according to claim 4, in which said combustion chamber of said steam generator, and said flue gas passes, are disposed one after the other in such a way that said flue gas pass that is associated with said water-steam circulation is disposed between said combustion chamber and said flue gas pass that is associated with said low pressure-heat carrier-circulation.

7. A steam generator according to claim 6, which includes a rising combustion chamber and descending flue gas passes, with a free space being provided between said combustion chamber on the one hand, and said flue gas passes on the other hand; with said means for receiving a partial flow of flue gas from one of said passes and conveying it into the other pass, at said specified level where the temperatures are approximately equal, being a line that is disposed at least partly in said free space.

* * * * *